US006533135B1

(12) United States Patent
Ford et al.

(10) Patent No.: US 6,533,135 B1
(45) Date of Patent: Mar. 18, 2003

(54) PORTABLE LIFTING FRAME

(76) Inventors: Carl Stephen Ford, 10 Longford Turning Farm, Market Drayton, Shropshire (GB), TF9 3PH; Timothy George Henson, 12 Sunnybank Close, Hardwick Grange, Streetly Aldridge, West Midlands (GB), WS9 0YR ( * ) Notice: Subject to any disclaimer, the term of this patent is extended or adjusted under 35 U.S.C. 154(b) by 0 days.

(21) Appl. No.: 09/714,805

(22) Filed: Nov. 16, 2000

(30) Foreign Application Priority Data

Nov. 17, 1999 (GB) ..... 9927069

(51) Int. Cl.[7] ..... B66C 5/02; A61G 7/10; A61G 7/14

(52) U.S. Cl. ..... 212/294; 5/85.1; 104/126

(58) Field of Search ..... 212/294, 314; 104/126; 5/85.1

(56) References Cited

U.S. PATENT DOCUMENTS

| | | | | |
|---|---|---|---|---|
| 4,296,509 A | 10/1981 | Simmons et al. | ..... | 5/81 |
| 5,165,123 A | 11/1992 | Colpron | ..... | 5/83.1 |
| 5,347,666 A | 9/1994 | Kippes | ..... | 5/81.1 |

FOREIGN PATENT DOCUMENTS

| | | |
|---|---|---|
| EP | 0 506 245 | 9/1992 |
| GB | 954371 | 4/1964 |
| GB | 1 551 208 | 8/1979 |
| GB | 2 260 751 | 4/1993 |
| GB | 2306941 | 5/1997 |
| JP | 7-330284 | 12/1995 |
| WO | WO 94/15570 | 7/1994 |

*Primary Examiner*—Steven A. Bratlie
(74) *Attorney, Agent, or Firm*—Michael D. Rechtin; Foley & Lardner

(57) ABSTRACT

A portable lifting frame comprises an elongate track provided with a bogie movable there along. The bogie is adapted to accept a lifting device. An elongate support is provided for the track wherein the track and support are made up of two or more cojoining portions 2*a* and 2*b*. The co-joining portions 2*a* and 2*b* are hinged together end to end at pivotal hinges 3. The co-joining portions 2*a* and 2*b* have an open position where they lie in the same place and a closed position where they lie parallel to each other. The support is provided with two or more legs 4, 5, 6, 7 pivotally attached to one end of the support where only each leg is extendable. The other end of the support is provided with a support element.

17 Claims, 8 Drawing Sheets

PORTABLE LIFTING FRAME

The present invention relates to a portable lifting frame particularly for lifting physically impaired or infirm people (hereinafter "the user"), for example, for moving the user from one position, such as a bed or chair, to another position, such as a wheelchair.

A variety of lifting devices are known for moving physically impaired or infirm people and generally comprise a lifting means, a sling and a support frame which may be integral with a wheelchair or may be a stand alone frame. These known devices generally allow the user to be lifted out of the wheelchair or a chair or bed and moved to another location while supported. by the sling and the frame which is usually provided with wheels.

The known devices are generally not portable owing to their weight and bulk and cannot therefore easily be transported by the user and/or an assistant when travelling. The known devices generally have elongate forward facing support feet which cannot traverse under fixed objects such as a floor level bed or an armchair without legs.

An object of the present invention is therefore to provide a lightweight, durable and transportable lifting frame. The frame can be easily carried as part of the user's luggage and can be erected, put away, used and carried by a single person.

According to a first aspect the present invention provides a portable lifting frame comprising an elongate track provided with a bogie moveable therealong and adapted to accept a lifting device, elongate support means for the track, wherein the track and support means are made up of two or more conjoining portions, the portions being pivotally hinged together end to end and having an open position where they lie in the same plane and a closed position where they lie parallel to each other, the support means being provided with two legs pivotally attached to one end of the support means and each leg being extendible, the other end of the support means being provided with a support element.

The support element preferably comprises two further legs pivotally attached to the support means, each leg being extendible. The support element may alternatively comprise a wall mounted bracket assembly or any other suitable support.

It is advantageous for the legs to be extendible and the track and support means to be provided in two or more conjoining portions so the frame can be folded up providing an easily portable article.

The portions of the support means are preferably substantially U-shaped with the track positioned in or depending from the base of each U-shaped portion of the support means. The portions of the U-shaped support means are preferably hinged together at the contacting ends thereof by hinge means positioned on the ends of the side walls of the U-shaped portions furthest from the base of the U-shape.

The support means preferably comprises two conjoined portions.

The legs are preferably pivotally attached to the side walls of the U-shaped portion of the support means.

The use of U-shaped support means provides a complete, elongate enclosed carrying case when the two portions of the support means are pivoted around the hinges.

The position of the hinges allows pivoting of the two portions of the support means so removing the need for means to lock the support means in the open position, although locking means may be provided, as the weight of a load on the lifting frame pulls down on the support means bringing the contacting edges of the two portions of the support means into contact with each other. In the closed position the two portions are parallel to each other forming a portable article.

The portions of the U-shaped support means are preferably made from a lightweight material such as aluminium or a suitable composite material. The portions of the support means are furthermore preferably provided with a system of strengthening tie bars around the perimeter thereof.

The use of strengthening tie bars allows the portions of the support means to be made from a lightweight material but maintain the required strength characteristics for the lifting frame.

The lifting frame is preferably provided with means to releasably lock the legs in the open position. The releasable locking means is preferably a spring biased bolt which acts between the support means and the leg.

Preferably the legs are telescopically extendible and may comprise three telescopically engaging portions—upper, middle and lower portions.

Means are provided to lock the separate telescopic portions of the legs in the extended position, again the locking means are spring biased bolts engaging corresponding apertures in the portions of the legs.

The upper telescopic leg portion is preferably of a larger diameter than the middle telescopic leg portion which is of larger diameter than the lower telescopic leg portion. The upper and middle telescopic leg portions are preferably provided with inwardly extending stop members around the lower ends thereof which engage outwardly extending shoulders provided around the upper end of the middle and lower telescopic portions.

The corresponding stops and shoulders prevent the upper, middle and lower telescopic portions from becoming separated from each other and facilitate alignment of the spring biased bolts with the aperture in the legs. The legs are locked in the extended position by rotation of the middle portion within the upper portion and the lower portion within the middle portion once the legs are extended so that the stops and shoulders contact until the spring biased bolts engage the corresponding holes provided.

The bogie is preferably provided with a hook portion adapted to receive a lifting device for lifting the user. Preferably means are provided to restrict movement of the bogie when not in use. The means to restrict movement may be a spring means acting on the hook portion to bias it towards an upper portion of the track and therefore a load must be applied to the hook before the bogie can move freely.

The present invention will now be further described by means of example only with reference to the drawings in which:

FIG. 1 shows a perspective view of the lifting frame of the present invention;

FIG. 2*a* shows the lifting frame of FIG. 1 partly put away;

FIG. 2*b* shows the lifting frame of FIG. 1 fully put away in its carrying form;

FIG. 3 shows a portion of the strengthening tie bar system used in the lifting frame of the present invention;

FIG. 4*a* shows a cross section through an end of a casing portion and

FIG. 4*b* shows a casing leg of the casing portion with a tube between a pair of apertures;

Figure 1:
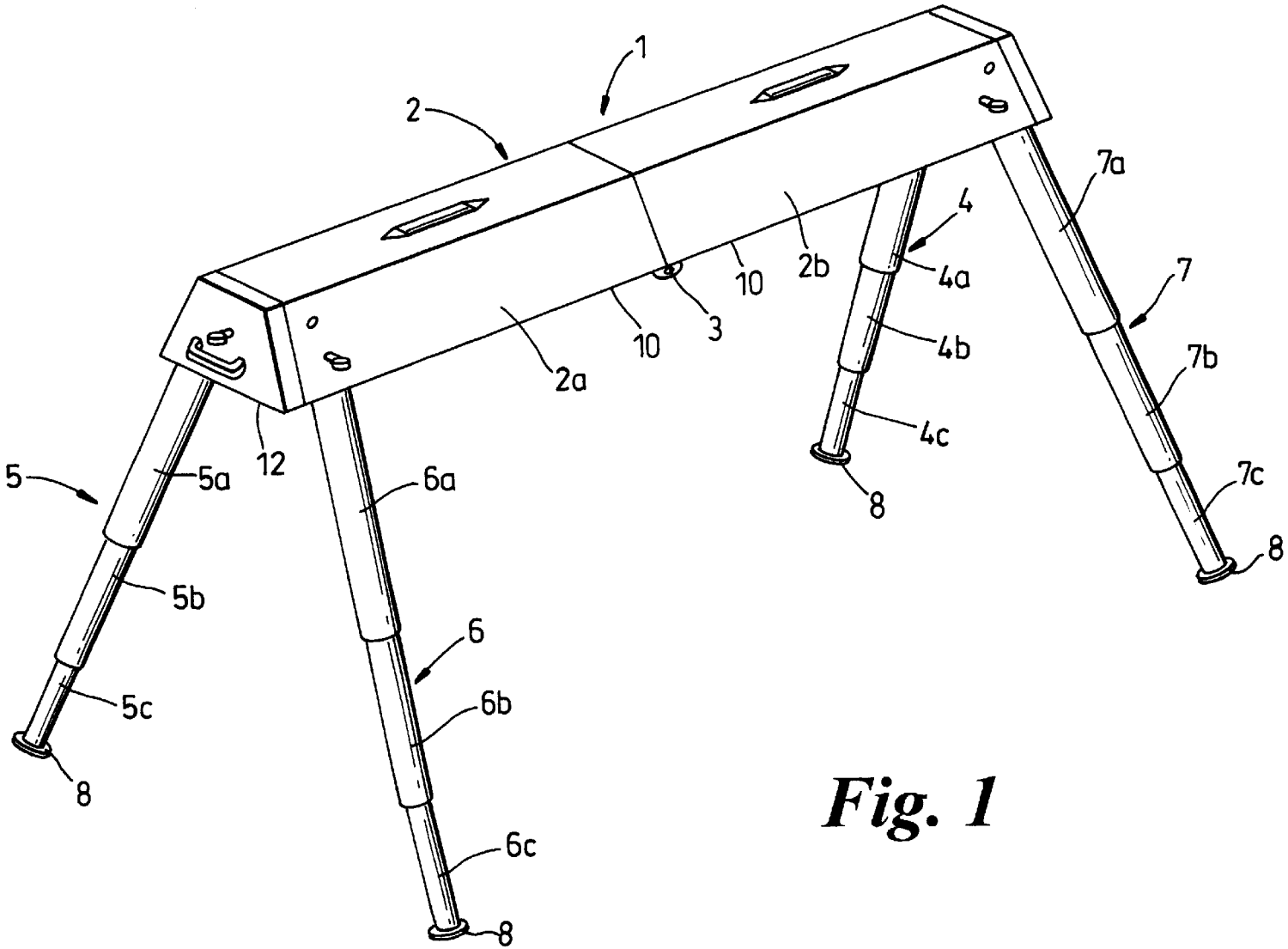
Figure 3:
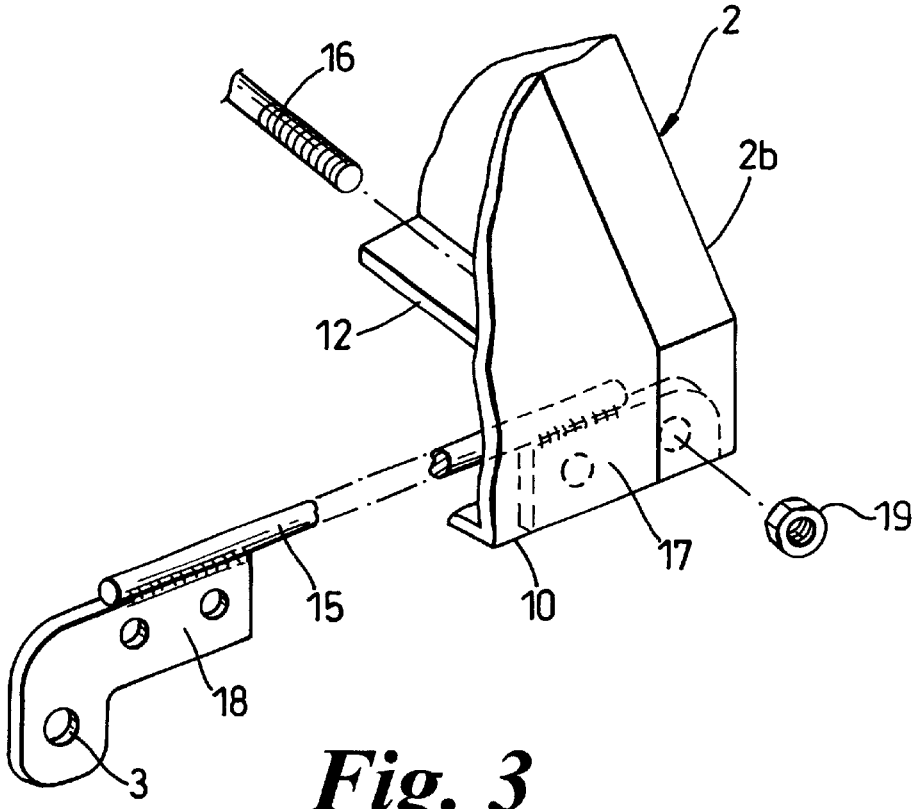

FIG. 1 shows a lifting frame 1 which comprises a light weight casing 2 made of aluminum and comprising portions 2*a* and 2*b* having long sides 10 and short sides 12 which are mirror images of each other and are hinged together at pivot hinges 3. FIG. 3 shows an alternative embodiment of the invention. In FIG. 1, the portions 2*a* and 2*b* of the casing 2 are provided with a system of tie bars (not shown in FIG. 1) extending around the perimeter of the lower edge of the casing 2 made up of long sides 10 and short sides 12 to provide the casing with rigidity and strength.

The frame is provided with four telescopically extendible legs 4, 5, 6 and 7. Each leg comprises three telescopic portions, upper portion a, middle portion b and lower portion c which can be locked in the extended position. Each leg is provided with a foot 8 which is movable to correspond to the ground surface on which is positioned.

When viewed from the end the legs of the lifting device are each angled at 22.5° to the vertical. When viewed from the side the legs are each angled at 10° to the vertical.

The legs 4, 5, 6 and 7 are pivotally secured inside the casing 2 so that when the lifting frame is folded away the legs 4, 5, 6 and 7 pivot and lie inside the casing 2.

Figure 2A:
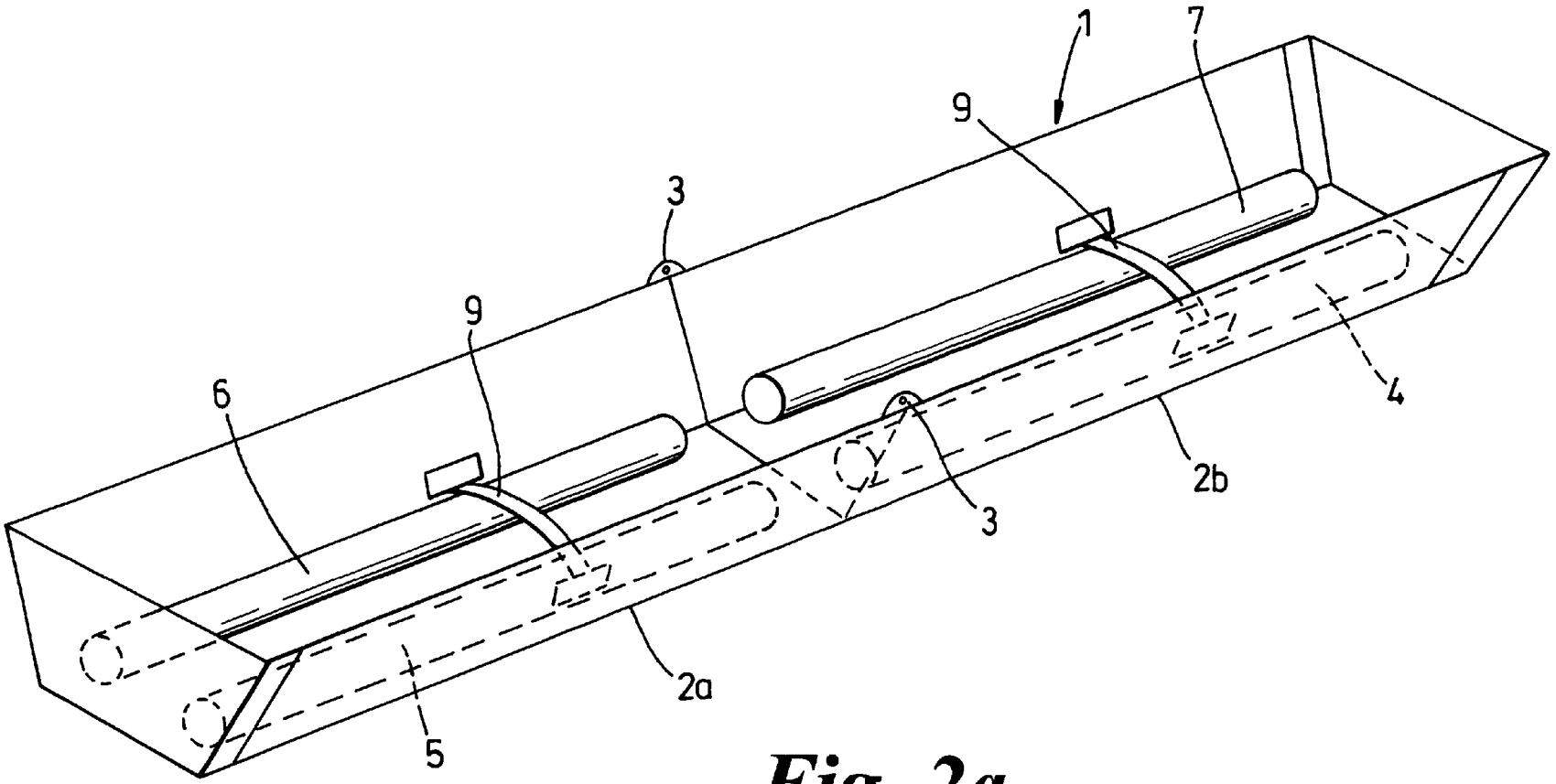

FIG. 2*a* shows the lifting device 1 folded away so that the legs 5 and 6 are received in the portion 2*a* of the casing 2 and the legs 4 and 7 are received in the portion 2*b* of the casing 2. The legs 4, 5, 6 and 7 are held in position within the portions 2*a* and 2*b* of the casing 2 by straps 9. Other suitable locking means may be provided to hold the legs 4, 5, 6 and 7 in the casing.

Figure 2B:
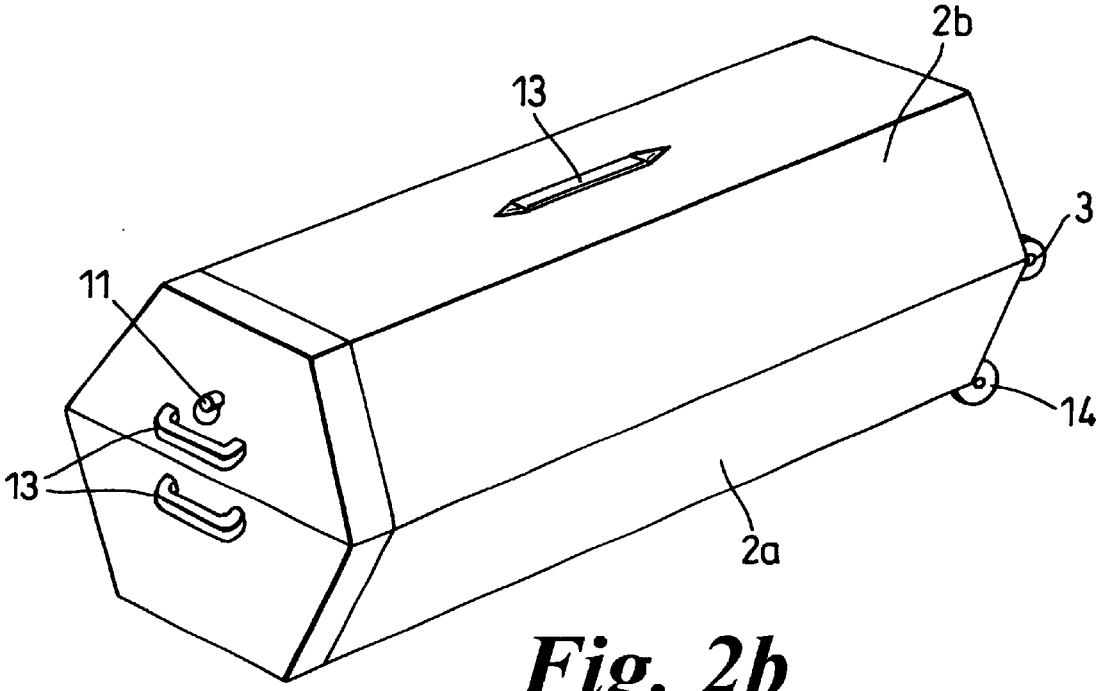

The portions 2*a* and 2*b* of the casing 2 are then pivoted around hinges 3 to form a complete casing as shown in FIG. 2*b* which is locked in the closed position by means of a latch 11 and provided with handles 13 to aid carrying. The casing is also provided with a set of wheels 14 attached to the portion 2*a*.

FIG. 3 shows the tie bar assembly in portion 2*b* of the casing 2. A main tie bar 15 is provided extending down the long sides 10 of portions 2*a* and 2*b* and transverse tie bars 16 are provided extending along the short sides 12 of the portions 2*a* and 2*b* of the casing 2.

The tie bars 15 and 16 are cylindrical steel rods of diameter 5–6 mm.

One end of the tie bar 15 is welded to a strengthening means 17 which is secured by means of bolts (not shown) to the inside face of the long side 10 at the end where it meets the short side 12. The other end of the tie bar 15 is secured by welding to a second strengthening means 18 which is provided with the pivotal hinge means 3.

The transverse tie bar 16 extends across the short sides 12 of the portions 2*a* and 2*b* of the casing 2 and is secured at each end to the strengthening means 17 by means of a nut 19 which co-operates with a screwthread on the tie bar 16. The tie bars 15 and 16 are linked by means of the strengthening means 17 and 18 and the pivotal hinge means 3 to form a continuous tie bar system adding strength to the casing 2.

Figure 4B:
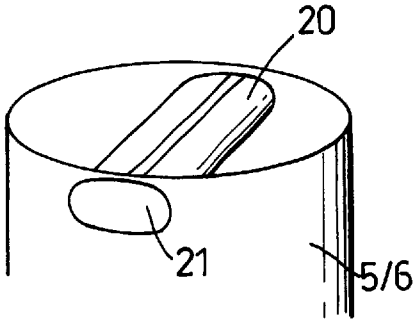
Figure 4A:
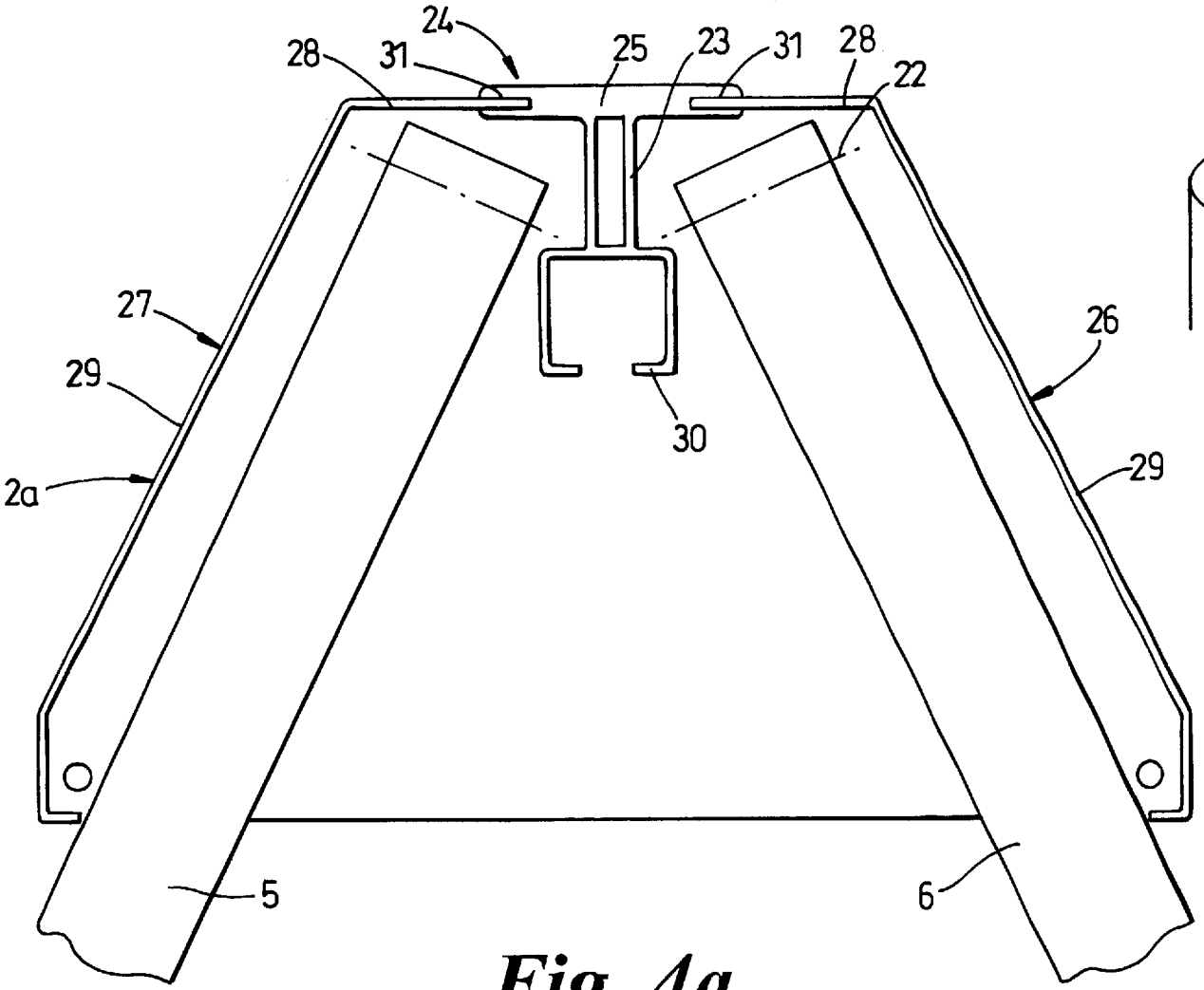

FIG. 4*a* shows a cross section through the end of either portion 2*a* or 2*b* of casing 2 detailing the attachment of the legs 4, 5, 6 and 7. Considering portion 2*a* of casing 2 as an example the legs 5 and 6 are cylindrical tubes made of aluminium. FIG. 4*b* shows that the legs 5 and 6 are provided with tubes 20 extending across their diameter between two a pertures 21 (only one aperture is shown) and welded in position. The tubes 20 each receive a rod 22 which extends through the side of the casing portion 2*a,* through the tube 20 and into a block (not shown) secured to the base of the portion 2*a* of the casing 2. The legs 5 and 6 are free to pivot around rods 22 from the folded away position of FIG. 2*a* to the open position of FIG. 1. The rods 22 are provided with head caps (not shown) to hold them in position against the side of the portion 2*a* of the casing 2 and the block.

FIG. 4*a* also shows the way in which the casing 2 is constructed and how a track for a bogie is secured to the casing 2.

The portions 2*a* and 2*b* of casing 2 are each made up of three parts. An elongate central extrusion 24 is provided which comprises a means 23 of locating the block to receive rods 22 depending downwardly from an elongate central member 25 and a C-shaped track portion 30 which depends from the means 23 with the open portion of the C-shaped member facing away from the means 23. The elongate central member 25 is provided with grooves 31 running down each side for receipt of side portions 26 and 27. The side portions 26 and 27 are mirror images of each other and each comprises a horizontal top surface 28 which engages the grooves of the elongate central member 25 and is held in place by rivets (not shown) and side portions 29 depending downwardly from the top portions at an angle of 22.5° to the vertical.

Figure 5:
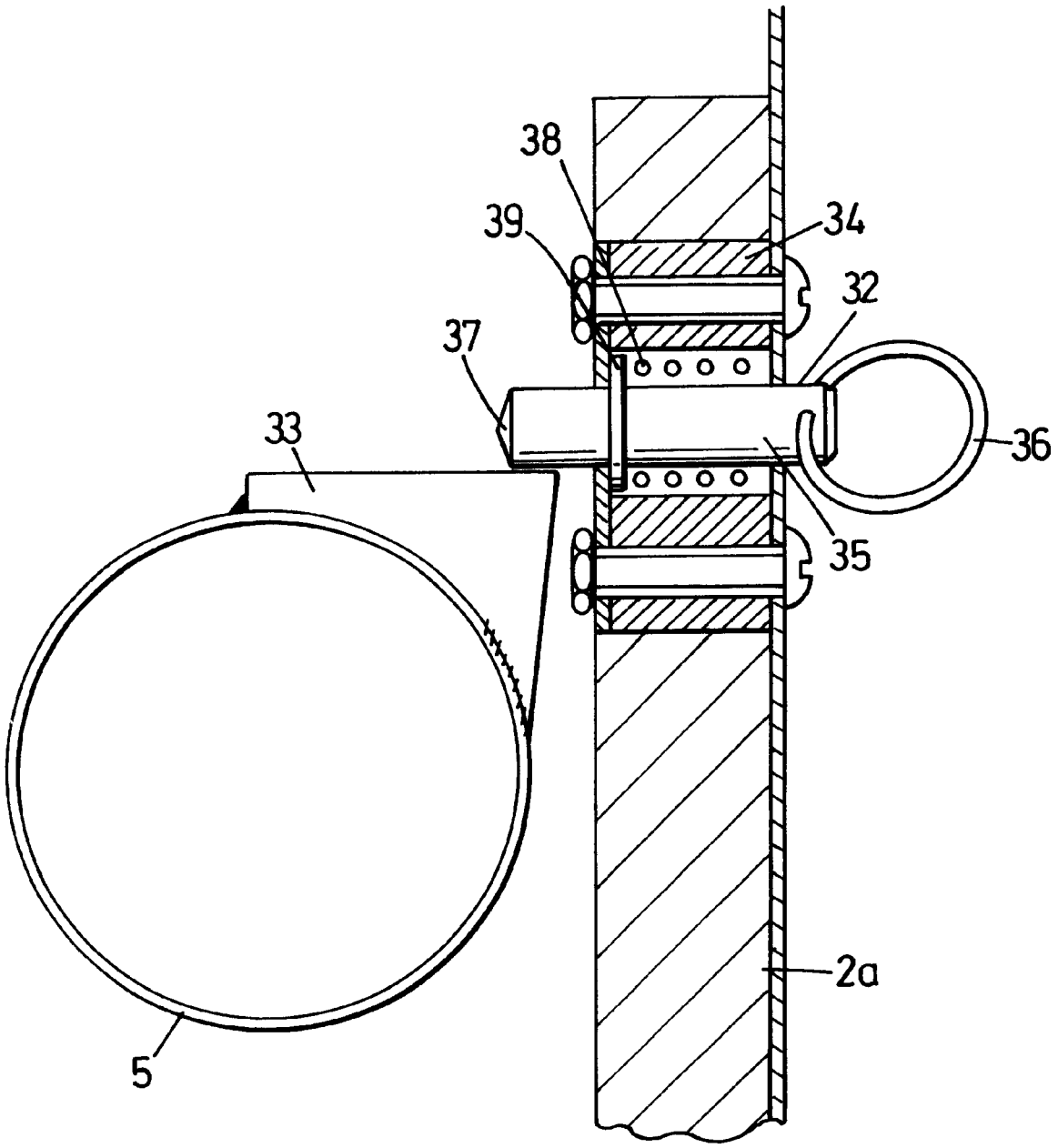
FIG. 5 shows a top view of the lifting frame detailing the mechanism used to lock the legs in place.

The manner in which the legs 4, 5, 6 and 7 are locked in the open position is illustrated in FIG. 5 with reference to leg 5 and portion 2*a* of casing 2.

The legs are locked in the open position by a spring loaded bolt 32 engaging with a cam surface 33 provided on leg 5. The bolt 32 is provided in a block 34 held in position in an aperture in the side wall of the portion 2*a* by means of screws. The bolt 32 comprises an elongate shaft 35 passing through the block 34 having a pull ring 36 on one end of the shaft and a cam engaging surface 37 on the other end. The shaft 35 is surrounded by a spring 38 which acts between a stop 39 on the shaft 35 and the inside of the portion of the casing 2*a* to bias the bolt 32 towards the leg 5.

In use the leg 5 pivots around rod 22 and on contacting the spring biased bolt 32 the cam engaging surface 33 of the bolt 32 travels over the cam by the allowing action of the spring 38 until the end of the cam surface where the spring 38 acts to push the bolt 32 into engagement with the rear surface of the cam to hold the leg in position.

To unlock the leg pressure is applied to the bolt against the spring 38 by means of the ring 36 to release the engagement of the bolt with the rear of the cam surface 33.

Figure 6:
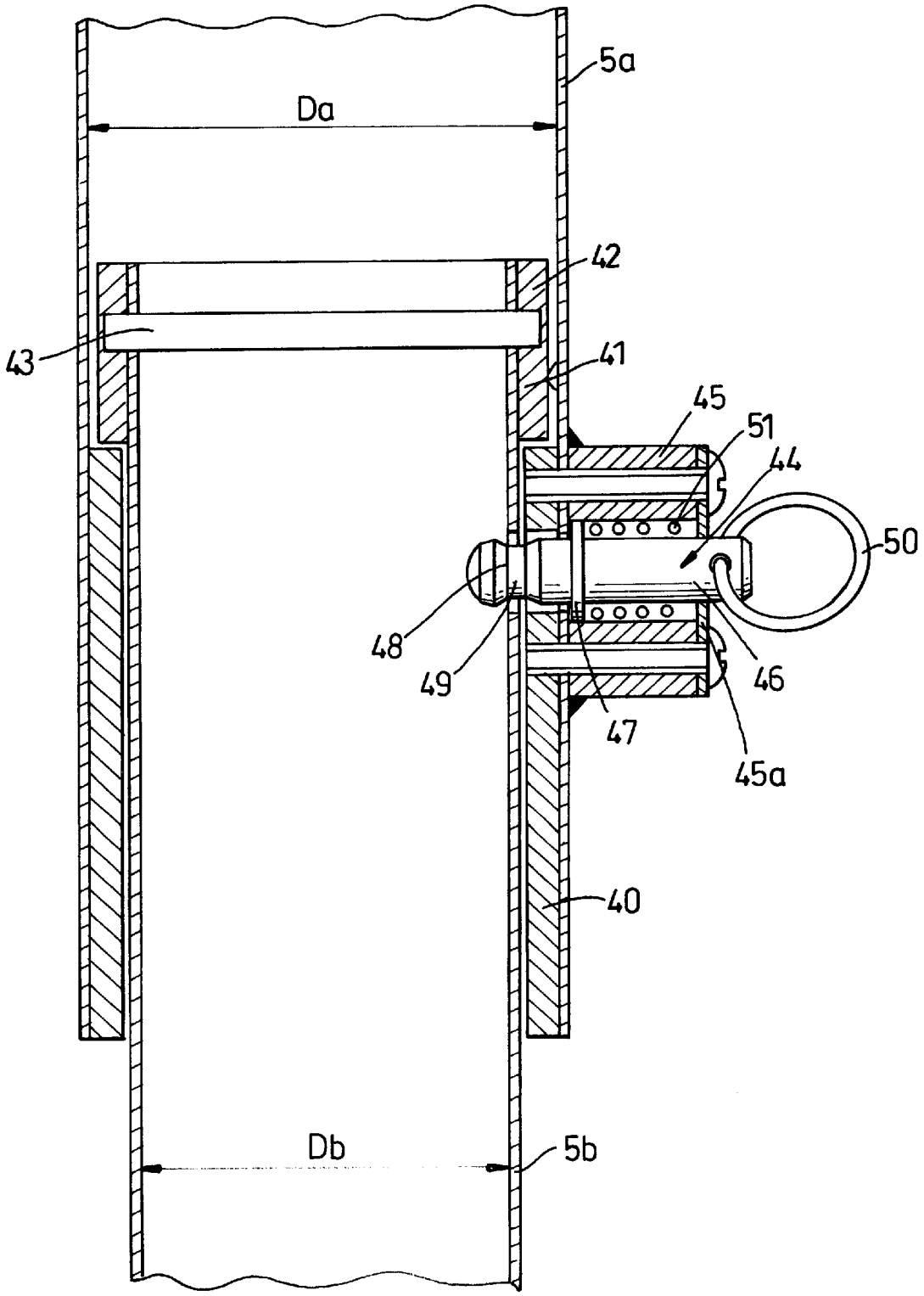
FIG. 6 shows a cross-sectional view of the telescopic leg arrangement.

FIG. 6 shows the telescopic leg detail and locking mechanism. FIG. 6 shows portions 5*a* and 5*b* of the leg 5 and it can be seen that portion 5*a* has a larger diameter (Da) than portion 5*b* (Db). Portion 5*a* is provided with a stop 40 around its inner perimeter at its lower end. Portion 5*b* is provided with a shoulder 41 extending outwardly around its upper perimeter and shoulder 41 engages stop 40 so that portion 5*b* can rotate within portion 5*a* but cannot be removed therefrom.

The shoulder 41 comprises a cylindrical sleeve 42 received outside portion 5*b* and held in position by a free rod 43 passing through apertures in sleeve 42 and portion 5*b* of the leg 5.

The locking mechanism used to lock the telescopic legs in the extended position includes a spring biased bolt 44 received in a block 45 mounted on the outside of portion 5*a* in the area having stop 40 by means of screws passing through block 45 into stop means 40.

The bolt 44 comprises a shaft 46 held inside the block 45 by the provision of a stop 47 and a head portion 48 which passes through an aperture in the stop 40 provided on the portion 5*a* and engages an aperture provided in the portion 5*b* by action of a spring 51 provided around the shaft 46 and acting between the stop 47 and the inside face of the outside plate 45*a* block 45. The head portion 48 is provided with an area of reduced diameter 49 so that when a load is applied to the lifting frame the wall of the portion 5*b* of the leg 5 engages the area of reduced diameter 49 and prevents the bolt 44 from being removed from the aperture in portion 5*b*.

To fold the leg 5 away the load is removed from the frame and pressure is applied to ring 50 of bolt 44 against the action of spring 51 to remove the head portion 48 from aperture in portion 5*b*. The portion 5*b* can then be slid inside portion 5*a*.

To extend leg 5 the portion 5*b* is slid out of portion 5*a* until shoulder 41 contacts stop 40. The portion 5*b* is then rotated with the shoulder and stop in contact until the spring loaded bolt 44 engages the aperture in portion 5*b* and locks the portions 5*a* and 5*b* on the extended position.

The mechanism is the same for portions 5*b* and 5*c* and in the remaining legs 4, 6 and 7.

Figure 7:
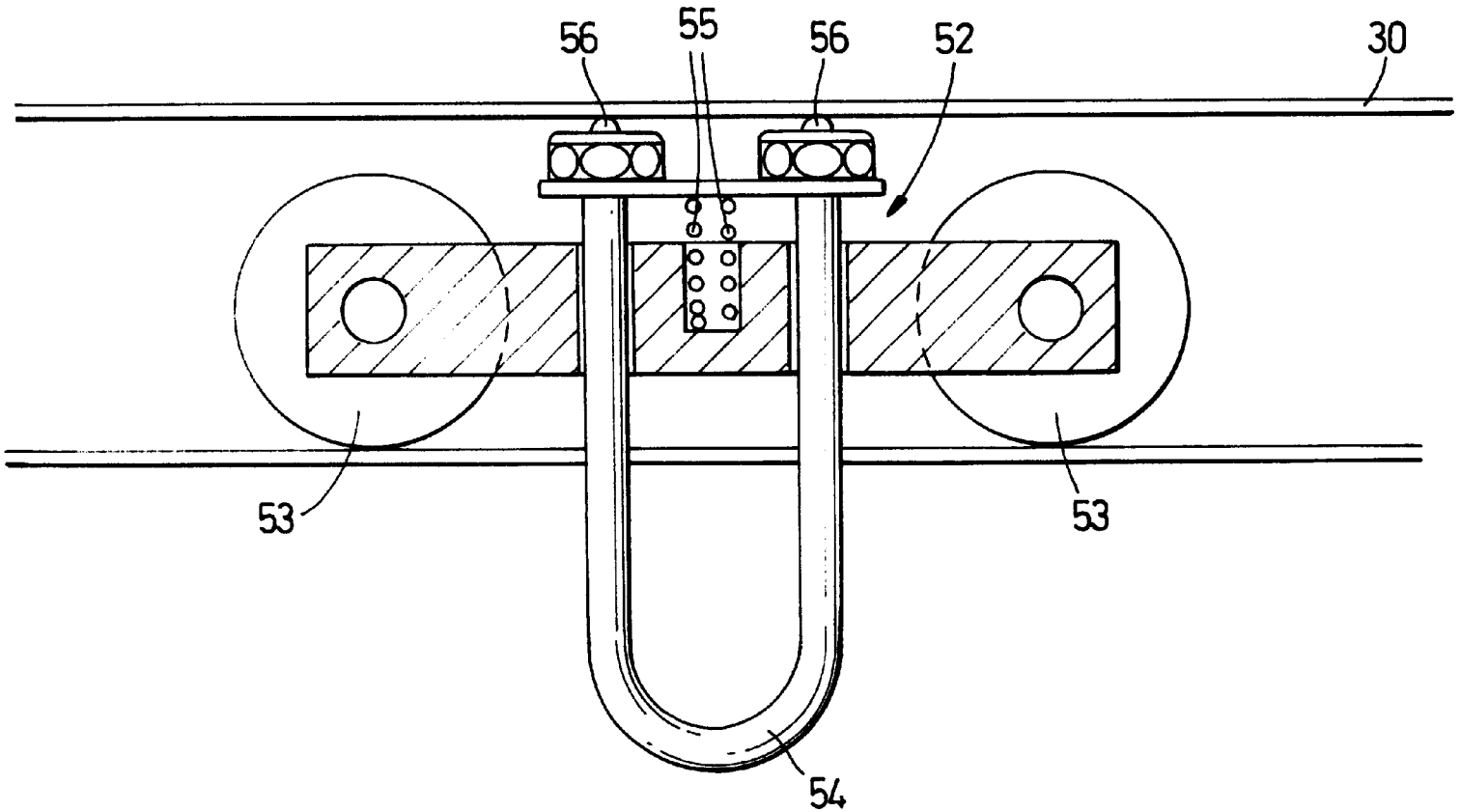
FIG. 7 shows a cross-sectional view of the bogie according to the present invention.
Figure 8:
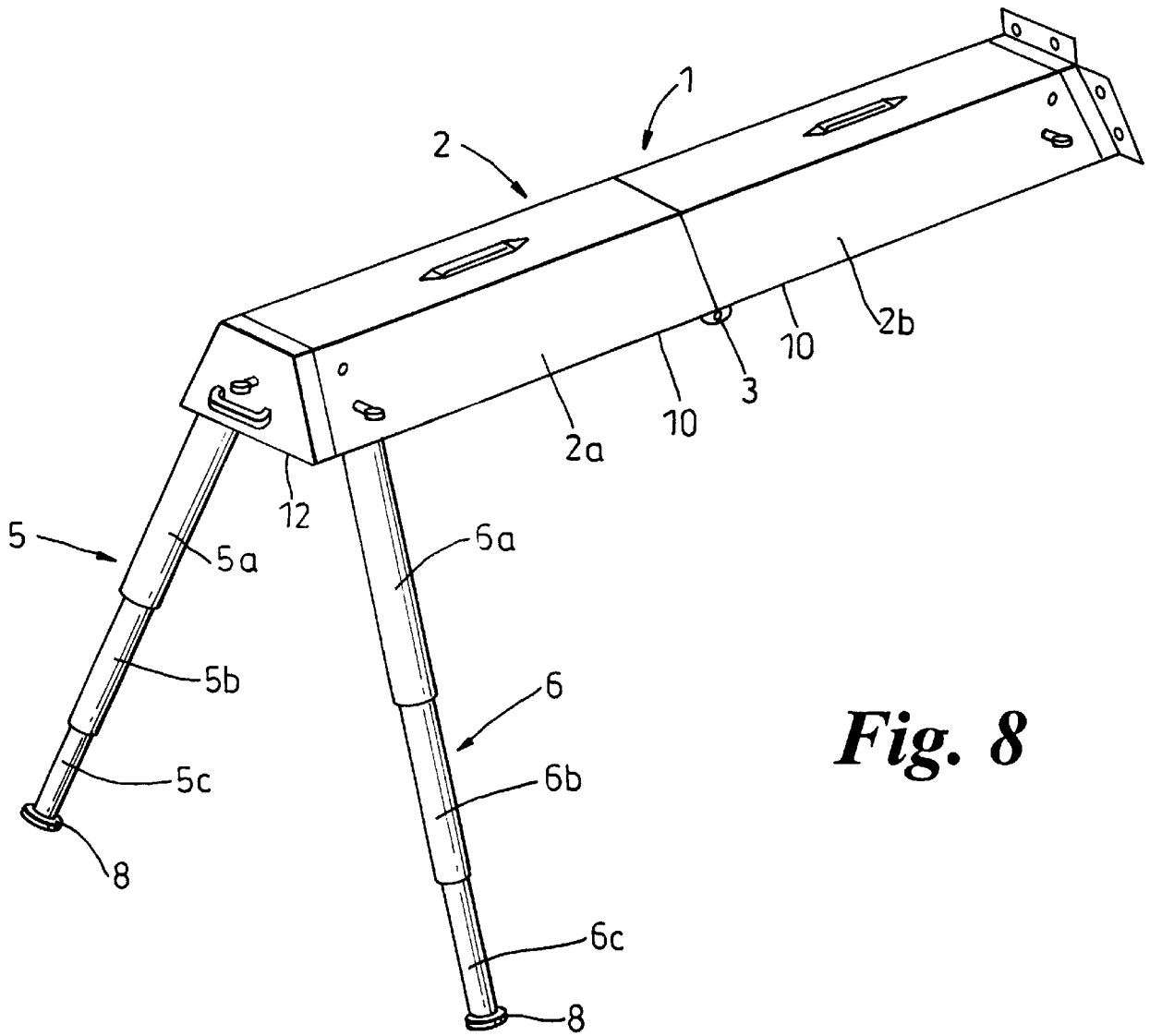
FIG. 8 shows a perspective view of the lifting frame of the present invention wherein the support element comprises a wall mounted to the bracket assembly.

FIG. 7 shows a load bearing bogie 52 which is provided with wheels 53 and runs along the C-shaped track 30 (see FIG. 4) extending longitudinally from one end of each portion 2*a* and 2*b* of the casing 2 to the other end.

The bogie 52 is provided with a hook 54 extending downwardly therefrom to have a lifting device such as a battery powered lifting device and sling for a physically impaired or infirm person attached thereto. The hook 54 is spring biased upwards towards the top of the track 30 by spring 55 so that when the load is removed the hook 54 is urged upwards towards the upper portion of track 30 and the free ends thereof contact the upper portion of the track and are provided with stop means 56 to restrict unwanted movement of the bogie 52 when the load is removed.

In use the lifting frame 1 of the present invention is carried in the casing 2 in the form shown in FIG. 2*b*. To erect the lifting frame the casing 2 is opened out around pivot hinges 3 as shown in FIG. 2*a*. The straps 9 holding the legs 4, 5, 6 and 7 in position are undone and the legs 4, 5, 6 and 7 are opened out around pivot rods 22 until the rear of cam surfaces 33 are engaged by bolts 32 and thus locked in the open position.

The legs 4, 5, 6 and 7 can then be extended by sliding the middle portion b out of the upper portion a, until the shoulders 41 contact stops 40 as described in relation to FIG. 6, the portion b can then be rotated until bolt 44 engages the aperture in portion b. This is then repeated to portion c in relation to portion b.

The lifting frame 1 is then moved to its upright position which may be spanning a bed and a chair to allow movement of a user from one to the other using a sling worn by the user and attachable to a lifting device and then to the hook portion 54 of the bogie 52. The sling is movable up and down by battery power and the user can move along the track 30 in the sling alone or with the help of another person. The portion 2*a* and 2*b* of the casing 2 need not be locked in the open position as the downward pressure exerted by the application of a load pulls the two portions together around hinges 3 and also ensures that bolt 44 cannot be unlocked when a load is applied. The application of a load also releases bogie 52 so that it can freely move along tracks 30.

It will be appreciated that although the lifting frame of the present invention has been described principally for movement of a physically impaired or infirm person the skilled person will recognise that the device can be used whenever portable lifting means are required.

What is claimed is:

1. A portable lifting frame comprising an elongate track provided with a bogie moveable therealong and adapted to accept a lifting device and elongate support means for the track, wherein the track and support means are made up of two or more conjoining portions, the portions being pivotally hinged together end to end having an open position where they lie in the same plane and a closed position where they lie parallel to each other, the support means being provided with two or more legs pivotally attached to one end of the support means and each leg being extendible, the other end of the support means being provided with a support element.

2. A portable lifting frame according to claim 1 wherein the support element comprises two or more further legs pivotally attached to the support means, each leg being extendible.

3. A portable lifting frame according to claim 1 wherein the support element comprises a wall mounted bracket assembly.

4. A portable lifting frame according to claim 1 wherein the support means comprises two conjoined portions.

5. A portable lifting frame according to claim 1 wherein the support means is provided with a system of strengthening tie bars around the perimeter thereof.

6. A portable lifting frame according to claim 1 wherein the lifting frame is provided with means to releasably lock the legs in the open position.

7. A portable lifting frame according to claim 6 wherein the releasable locking means is a spring biased bolt which acts between the support means and the leg.

8. A portable lifting frame according to claim 1 wherein the legs are telescopically extendible.

9. A portable lifting frame according to claim 2 wherein the legs are telescopically extendible.

10. A portable lifting frame according to claim 8 wherein means are provided to lock separate telescopic portions of the legs in an extended position, the locking means are spring biased bolts engaging corresponding apertures in the portions of the legs.

11. A portable lifting frame according to claim 9 wherein means are provided to lock separate telescopic portions of the legs in an extended position, the locking means are spring biased bolts engaging corresponding apertures in the portions of the legs.

12. A portable lifting frame according to claim 1 wherein the bogie is provided with a hook portion adapted to receive a lifting device for lifting the user.

13. A portable lifting frame according to claim 1 wherein means are provided to restrict movement of the bogie when not in use.

14. A portable lifting frame according to claim 13 wherein the means to restrict movement is a spring means acting on the hook portion to bias it towards an upper portion of the track and therefore a load must be applied to the hook before the bogie can move freely.

15. A portable lifting frame according to claim 1 wherein the portions of the support means are substantially U-shaped with the track positioned in or depending from the base of each U-shaped portion of the support means.

16. A portable lifting frame according to claim 15 wherein the portions of the U-shaped support means are hinged together at the contacting ends thereof by hinge means positioned on the ends of the side walls of the U-shaped portions furthest from the base of the U-shape.

17. A portable lifting frame according to claim 15 wherein the legs are pivotally attached to the side walls of the U-shaped portion of the support means.

* * * * *